8-108.1 SR
F6966 XR 4,174,289

United States Patent [19]
Sorgenfrei et al.

[11] 4,174,289
[45] Nov. 13, 1979

[54] LIQUID DETERGENT-BLEACH CONCENTRATES HAVING HIGH ALKALINITY

[75] Inventors: Malachi E. Sorgenfrei, Grosse Ile; Donald F. Garvin, Wyandotte, both of Mich.

[73] Assignee: BASF Wyandotte Corporation, Wyandotte, Mich.

[21] Appl. No.: 937,691

[22] Filed: Aug. 28, 1978

Related U.S. Application Data

[63] Continuation-in-part of Ser. No. 819,261, Jul. 27, 1977, abandoned.

[51] Int. Cl.[2] ..... C11D 7/54
[52] U.S. Cl. ..... 252/103; 252/95; 252/99; 8/108 A; 134/2; 134/42
[58] Field of Search ..... 252/95, 99, 103; 8/108; 134/2, 40, 42

[56] References Cited

U.S. PATENT DOCUMENTS

| | | | |
|---|---|---|---|
| 3,172,681 | 3/1965 | Steinhauer et al. | 252/95 X |
| 3,728,266 | 4/1973 | Romeda et al. | 252/95 X |
| 3,758,409 | 9/1973 | Nakagawa et al. | 252/99 |
| 3,793,212 | 2/1974 | Gray et al. | 252/99 |
| 3,929,661 | 12/1975 | Nakagawa et al. | 252/103 |
| 4,029,591 | 6/1977 | Ohbu et al. | 252/103 |
| 4,071,463 | 1/1978 | Steinhauer | 252/103 |

FOREIGN PATENT DOCUMENTS

| | | | |
|---|---|---|---|
| 715910 | 10/1931 | France | 252/103 |

*Primary Examiner*—Mayer Weinblatt
*Attorney, Agent, or Firm*—Andrew E. Pierce; Joseph D. Michaels; Robert E. Dunn

[57] ABSTRACT

There are disclosed liquid detergent-bleach concentrates of high alkalinity which are clear solutions having excellent long term stability at elevated temperatures and at low temperatures. The concentrate compositions consist essentially of an alkali metal hypochlorite, alkali metal chloride, an alkali metal salt of an alkylated diphenyl oxide sulfonic acid, and metal chelating agents in an aqueous composition having a high proportion of alkali metal hydroxide. The concentrates are useful upon dilution in forming hard surface cleaning compositions which are particularly useful in removal of oily soils, derived from animal and vegetable oils.

8 Claims, No Drawings

LIQUID DETERGENT-BLEACH CONCENTRATES HAVING HIGH ALKALINITY

CROSS REFERENCE TO RELATED APPLICATION

This is a continuation-in-part of copending application, Ser. No. 819,261, filed July 27, 1977, now abandoned.

BACKGROUND OF THE INVENTION

1. Field of the Invention

This invention relates to an aqueous cleaning and bleaching composition containing a stable, concentrated alkali metal hypochlorite composition.

2. Description of the Prior Art

It is known from U.S. Pat. No. 3,172,861 to combine a liquid alkali metal hypochlorite bleaching composition with a bleach-stable detergent which can be an alkylated diphenyl oxide sulfonic acid alkali metal salt and to obtain clear compositions which are storage-stable at room temperature and free of precipitate or cloudiness after 6 weeks to 4 months shelf-storage at room temperature. In the compositions disclosed therein it has been believed necessary to maintain the concentrations of ingredients proportionately low in order that the recognized tendency of organic materials to decompose in the presence of oxidizing agents will be minimized. In view of the disclosure contained in this reference therefor, it is unexpected that the applicants have discovered that hypochlorite concentrates containing an alkali metal hydroxide and an alkali metal chloride in addition to an alkali metal hypochlorite and an alkali metal salt of an alkylated diphenyl oxide sulfonic acid can be prepared which are clear, stable to storage at room temperature and at elevated temperatures and at low temperatures and upon dilution are more effective in oily soil removal than the compositions of the prior art.

While stable mixtures of sodium or calcium hypochlorite and a detergent together with compound such as alkali metal phosphates, silicates, carbonates or sulfates have been prepared in the dry state and utilized as cleaning compositions upon admixture with water, these dry compositions are intended to be mixed with water immediately prior to use and are neither stable in contact with water nor do they generally form clear aqueous solutions. Thus there is an unfulfilled need for an aqueous liquid concentrate containing an alkali metal hypochlorite, alkali and a detergent together with metal chelating agents and metal passivating agents which can be diluted with water prior to use to form a stable balanced detergent composition suitable for general purpose or hard surface cleaning. Unexpectedly, in the liquid concentrates of the invention, the presence of an equimolar amount of alkali metal chloride, based upon the alkali metal hypochlorite, does not adversely affect long-term storage stability or inhibit cleaning efficiency.

Other liquid detergent-bleach compositions are disclosed in U.S. Pat. No. 3,758,409, U.S. Pat. No. 3,929,661 and U.S. Pat. No. 3,560,389. Generally, such compositions contain structurally dissimilar detergents as compared to the detergent used in the compositions of the invention.

SUMMARY OF THE INVENTION

There are disclosed clear, stable at room temperature, at elevated temperatures and at low temperatures alkali metal hypochlorite-detergent concentrates which are useful, upon dilution with water, for general purpose, hard surface cleaning at temperatures of about 15° C. to about 80° C., and which are particularly useful in removing animal and vegetable based oily and fatty soil deposits normally encountered on processing equipment in the meat and poultry industry.

DESCRIPTION OF THE PREFERRED EMBODIMENTS

The concentrates of the invention contain high concentrations of alkali metal hydroxide and alkali metal chloride, said alkali metal chloride preferably present in an equimolar amount based upon the concentration of alkali metal hypochlorite, and can contain conventional metal chelating agents and synergists to increase cleaning efficiency. The detergent of the invention which is stable to oxidation in the presence of an alkali metal hypochlorite consists of an alkylated diphenyl oxide sulfonic acid alkali metal salt. The clear, long-term stable cleaning concentrate compositions of the invention are high in alkalinity and generally contain, on a weight basis, about 5 to about 20% alkali metal hydroxide, preferably about 8 to about 15% alkali metal hydroxide and most preferably about 10 to about 13%. Generally, the concentrates contain, on a weight basis, about 2 to 15% of an alkali metal hypochlorite, preferably about 2 to about 10% and most preferably about 2 to about 4%, all calculated as available chlorine, and about 0.1 mole to about 1.5 moles of an alkali metal chloride per mole of said hypochlorite. The proportion of the alkali metal salt of an alkylated diphenyl oxide sulfonic acid is generally about 15 to 200% by weight based upon the weight of an alkali metal hypochlorite, preferably about 60 to about 200% by weight and most preferably about 100 to about 200 by weight. It is also desirable to include as part of the composition minor amounts such as about 2% to about 8% each of certain conventional metal passivating or chelating agents such as phosphoric acid, potassium silicate and sodium tripolyphosphate for their known conventional effects as heavy metal chelating agents and for their known synergistic action in combination with alkali and a detergent in improving cleaning efficiency. Representative alkali metals are sodium, potassium and lithium. The concentrates are diluted with water for use at the point of use. Generally, active solution concentrations on a weight basis of about 0.5% to about 5% are used for cleaning hard surfaces at application temperatures of about 15° C. to about 80° C. and higher. Preferably about 1% to about 3% active total weight of the concentrate solution concentrations are used and most preferably about 1% to about 2% active solution concentrations are used. Cleaning is accomplished by application of the diluted concentrate of the invention to a hard surface to be cleaned followed by rinsing with water. Optionally, frictional force can be applied to loosen heavy layers of soil.

The alkali metal salts of alkylated diphenyl oxide sulfonic acids are known materials and methods for the preparation thereof are disclosed in U.S. Pat. No. 2,854,477 which is incorporated herein by reference. Generally, in the preparation of these detergents, alkyl diphenyl ethers are employed as starting materials.

These are prepared by methods known in the art such as by reaction of an unsaturated aliphatic hydrocarbon or saturated aliphatic monohalohydrocarbon with a diphenyl ether in the presence of a Friedel-Crafts catalyst. The sulfonating agent can be chlorosulfonic acid or sulfur trioxide and can be used in amounts of 2 to 2.3 moles per mole of the alkyl diphenyl ether. The sulfonated alkyl diphenyl ether is converted to the sulfonic acid salt of an alkali metal such as sodium or potassium in order to confer water solubility upon the molecule. Generally, the alkyl moiety of said alkylated diphenyl oxide sulfonic acid alkali metal salt has about 8 to about 22 carbon atoms and the sulfonate groups per diphenyl oxide group average about 1.8 to about 2.3.

In order to determine the relative cleaning efficiency of the concentrates of the invention upon dilution with water, the concentrate of the invention illustrated by Example 1 below was diluted to a solids concentration of 1% by adding water to the concentrate. For comparison purposes, as shown in Control Example 3, a 1% by weight solution was made, utilizing a concentrate containing 3% by weight sodium hypochlorite and 8% by weight of the sodium salt of sulfonated alkyl diphenyl oxide sold under the trademark "DOWFAX 3B-2" by the Dow Chemical Company, Midland, Michigan. In addition, an aqueous concentrate containing 3% by weight sodium hypochlorite was diluted to 1% and used as a control as shown in Example 4.

Cleaning efficiency was evaluated, using the method of evaporative rate analysis which has hitherto been applied mainly to analysis of the surface characteristics of metals as disclosed by Anderson in the November 1969 issue of the *Journal of Colloid and Interface Science.* In applying this test method to evaluate the effectiveness with which soil can be removed from a substrate, the difference in radioactivity is measured before and after cleaning of a soiled surface to which a test solution consisting of a radioactively tagged material in a volatile solvent has been applied. Evaluation is made subsequent to a period of time (i.e., about 3 to 5 seconds) during which the solvent, after having been applied to the soiled surface, is observed as having evaporated from the surface. For the purposes of the test method utilized herein, a radioactively tagged volatile solvent was utilized. By the method of evaporative rate analysis utilizing a surface analyzer, sold under the registered trademark "Meseran" by ERA Systems, Inc., the nonvolatile residue of the test solvent was determined subsequent to the application of a controlled amount of said solvent to the soiled surface to be evaluated. Approximately 20 microliters of test solvent is applied to the surface to be tested. Subsequent to the deposition on the surface to be tested of this amount of radioactively tagged volatile solvent, the solvent is allowed to interact with the surface by mechanisms such as adsorption, permeation, diffusion, solvation or absorption. It is believed that the rate of interaction is proportional to the amount of soil on the surface.

For the purposes of evaluation of soil retention in order to determine relative effectiveness of the cleaning composition of the invention, as compared to prior art cleaning compositions, a stainless steel rectangular panel, measuring five inches by two inches was soiled by coating with a solution of 0.5% chicken fat in petroleum ether. The soil was applied to the panel, using a 0.05 milliliter micropipet and the droplet applied thereby was applied by spreading over the panel surface, using a glass microscope slide. After drying, the samples are ready for use in evaluating the cleaning efficiency of the compositions of the invention. It should be noted that prior to the coating of the stainless steel panels with the chicken fat-petroleum ether composition, the panels were first cleaned using a commercial detergent, followed by immersion in boiling trichloroethylene for a period of 30 minutes. In order to determine cleanliness of the panels prior to coating with soil, the panels were evaluated, using the evaporative rate analysis method utilizing the Meseran® surface analyzer referred to above. By this method, a radioactively tagged solvent, believed to be a mixture of radioactively tagged 1,1,2,2-tetrabromoethane, 1,1,2-trifluorotrichloroethane and chloroform, was applied to three locations on the panel spaced approximately equal distance from each other and positioned along the lengthwise dimension of the panel. Cleaned panels show essentially no radioactivity upon evaluation.

In order to evaluate the cleaning efficiency of the compositions of the invention, the soiled panels, having a chicken fat coating applied as described above, were immersed in a 1% by weight aqueous solution of the detergent-bleach composition of the invention at a temperature of 150° F. for a period of 5 minutes. Comparison of the radioactivity retention prior to cleaning and subsequent to cleaning under said conditions, provides a measure of the efficiency of the cleaning solution. The cleaning composition of Example 2 was evaluated against the cleaning compositions of Examples 3 and 4 and the results are reported in the following table. In each case, panels were analyzed for retention of radioactivity prior to cleaning and subsequent to cleaning and the difference determined. Results are reported in the table as percent retention of soil, the cleaning composition showing the lowest percent retention of soil being the most efficient cleaning composition.

Table

CLEANING EFFICIENCY BY EVAPORATIVE RATE ANALYSIS

| Example No. | % Soil Retention After Cleaning at 150° F., 5 Min., 1% Solution | | |
|---|---|---|---|
| | Test No. 1 | Test No. 2 | Test No. 3 |
| 2 | 55 | 50.5 | 61 |
| 3 Control | 74 | 86 | 69 |
| 4 Control | 80 | 96 | 97 |

The following examples illustrate the various aspects of the invention including methods of preparing the compositions of the invention but are not intended to limit its scope. Where not otherwise specified throughout this specification and claims, temperatures are given in degrees Centigrade and parts, percentages and proportions are by weight.

EXAMPLE 1

A foaming, chlorinated liquid alkaline detergent concentrate useful in the preparation of aqueous cleaning compositions which are effective in removing fatty and oily soils from food processing equipment was prepared by combining the following ingredients. To a kettle there was added 51.5 parts by weight of water, 26 parts by weight of a 45% by weight solution of potassium hydroxide. The water and potassium hydroxide solution was thoroughly mixed and then there was added phosphoric acid, 3.5 parts by weight; potassium silicate, 2 parts by weight; and sodium tripolyphosphate, 6 parts by weight. After thoroughly dissolving these ingredients, 3 parts by weight of liquid chlorine was added to the mixture while under rapid agitation. By reaction of this chlorine with an equal molar amount of a portion of the potassium hydroxide present, equimolar amounts of potassium hypochlorite and potassium chloride are generated in situ in accordance with the following equation:

$$Cl_2+KOH \rightarrow KOCl+KCl$$

Upon attaining homogeneity of the mixture, there was added 4 parts by weight of the sodium salt of a sulfonated alkyl diphenyl oxide sold under the trademark "DOWFAX 3B-2" by the Dow Chemical Company, Midland, Michigan. It is understood that this material is sodium dodecyl diphenyl oxide disulfonate. This liquid composition formed a stable solution which was clear at room temperature, at 120° F. and at 0° F., which is the approximate freezing point of said solution. Such compositions show excellent storage stability and substantially unchanged clarity as well as freedom from separation and precipitation of ingredients when stored over an extended period of two months at a temperature of 120° F. or at a temperature of 0° F. as well as at room temperature. The alkali metal hypochlorite bleaching activity is retained in such concentrates upon extended storage, as noted above, so that upon dilution at the time of use substantial the same bleaching effect is obtained in comparison with freshly prepared and diluted concentrates.

EXAMPLE 2

The concentrate of Example 1 was diluted with water to a concentration of 1% by weight.

EXAMPLE 3 (Control)

A bleach-detergent composition of the prior art was prepared consisting of 3% by weight sodium hypochlorite, 8% by weight of the sodium salt of a sulfonated alkyl diphenyl oxide sold under the trademark "DOWFAX 3B-2" and water to 100%. The composition was diluted to a concentration of 1% by weight for use.

EXAMPLE 4 (Control)

A 3% by weight aqueous solution of sodium hypochlorite was prepared and further diluted with water to a concentration of 1% by weight for use.

The embodiments of the invention in which an exclusive property or privilege is claimed are defined as follows:

1. A cleaning and bleaching liquid composition consisting essentially of an aqueous solution of:

A. about 2% to about 15% by weight, calculated as available chlorine, of an alkali metal hypochlorite, B. about 15% to about 200% by weight of an alkali metal salt of an alkylated diphenyl oxide sulfonic acid based upon said alkali metal hypochlorite weight, C. about 5% to about 20% by weight of an alkali metal hydroxide, and D. about 0.1 mole to about 1.5 mole of an alkali metal chloride per mole of said hypochlorite wherein said alkali metal is selected from the group consisting of sodium, potassium, and lithium, and wherein said alkylated diphenyl oxide sulfonic acid contains about 8 to about 22 carbon atoms in the alkyl moiety.

2. The composition of claim 1 wherein said hypochlorite is selected from the group consisting of sodium hypochlorite and potassium hypochlorite and is present in the proportion of about 3% to about 10% by weight, calculated as available chlorine, and said alkali metal salt of an alkylated diphenyl oxide sulfonic acid is present in the proportion of about 30% to about 175% by weight on the basis of the weight of said hypochlorite.

3. The composition of claim 2 wherein said alkali metal salt of an alkylated diphenyl oxide sulfonic acid contains an average of about 1.8 to 2.3 sulfonate groups per diphenyl oxide moiety.

4. The composition of claim 3 wherein said composition consists essentially of about 2% to about 4% by weight of potassium hypochlorite, calculated as available chlorine, an equimolar amount of potassium chloride and about 100% to about 200% by weight of the basis of the weight of said potassium hypochlorite of said sulfonated alkyl diphenyl oxide.

5. The composition of claim 4 wherein said composition contains on a weight basis about 8% to about 15% of potassium hydroxide, about 2% potassium silicate, and about 6% sodium tripolyphosphate and wherein about 3.5% phosphoric acid is added thereto.

6. A method of cleaning hard surfaces comprising:

A. forming an aqueous solution of about 0.5% to about 5% by weight active solution concentration of the composition of claim 1, B. applying an effective amount of said mixture to said hard surface, and C. rinsing said surface with water.

7. The method of claim 6 wherein said mixture is applied at a temperature of about 15° C. to about 80° C. to hard surfaces soiled with animal and vegetable-based oily soils.

8. A method of cleaning hard surfaces comprising:

A. forming an aqueous solution of 0.5% to about 5% by weight active solution concentration of the composition of claim 5, B. applying an effective amount of said mixture to said hard surface, and C. rinsing said surface with water.

* * * * *